US010048052B2

(12) United States Patent
Burrow

(10) Patent No.: US 10,048,052 B2
(45) **Date of Patent: *Aug. 14, 2018**

(54) METHOD OF MAKING A POLYMERIC SUBSONIC AMMUNITION CARTRIDGE

(71) Applicant: True Velocity, Inc., Dallas, TX (US)

(72) Inventor: Lonnie Burrow, Carrollton, TX (US)

(73) Assignee: True Velocity, Inc., Dallas, TX (US)

( * ) Notice: Subject to any disclaimer, the term of this patent is extended or adjusted under 35 U.S.C. 154(b) by 62 days.

This patent is subject to a terminal disclaimer.

(21) Appl. No.: 14/863,567

(22) Filed: Sep. 24, 2015

(65) Prior Publication Data

US 2017/0089679 A1 Mar. 30, 2017
US 2017/0191811 A9 Jul. 6, 2017

Related U.S. Application Data

(60) Continuation-in-part of application No. 14/011,202, filed on Aug. 27, 2013, now Pat. No. 9,546,849,
(Continued)

(51) Int. Cl.
*F42B 33/00* (2006.01)
*F42B 5/307* (2006.01)
(Continued)

(52) U.S. Cl.
CPC ..... *F42B 33/001* (2013.01); *F42B 5/16* (2013.01); *F42B 5/307* (2013.01); *F42C 19/083* (2013.01); *F42C 19/0807* (2013.01)

(58) Field of Classification Search
CPC .. F42B 5/313; F42B 5/30; F42B 5/307; F42B 33/00; F42B 33/001; F42B 5/02; F42C 19/083; F42C 19/0823
(Continued)

(56) References Cited

U.S. PATENT DOCUMENTS 99,528 A 2/1870 Boyd
113,634 A 4/1871 Crispin
(Continued)

FOREIGN PATENT DOCUMENTS

CA 2813634 A1 4/2012
DE 16742 1/1882
(Continued)

OTHER PUBLICATIONS

Korean Intellectual Property Office (ISA), International Search Report and Written Opinion for PCT/US2011/062781 dated Nov. 30, 2012, 16 pp.
(Continued)

*Primary Examiner* — James S Bergin
(74) *Attorney, Agent, or Firm* — Chainey P. Singleton

(57) ABSTRACT

The present invention provides a method of making a subsonic ammunition cartridge having a polymeric casing body having a generally cylindrical hollow polymer body having a body base at a first end thereof and a mouth at a second end to define a propellant chamber; a propellant insert positioned in the propellant chamber to reduce the internal volume of the propellant chamber, wherein the propellant chamber has an internal volume that is between 25 and 80% less than the open internal volume of a standard casing of equivalent caliber; and a primer insert positioned in the body base and in communication with the propellant chamber.

17 Claims, 10 Drawing Sheets

Related U.S. Application Data which is a division of application No. 13/292,843, filed on Nov. 9, 2011, now Pat. No. 8,561,543.

(60) Provisional application No. 61/456,664, filed on Nov. 10, 2010.

(51) Int. Cl.
*F42C 19/08* (2006.01)
*F42B 5/16* (2006.01)

(58) Field of Classification Search
USPC ..... 102/466, 465, 467, 470
See application file for complete search history.

(56) References Cited

U.S. PATENT DOCUMENTS 130,679 A 8/1872 Whitmore
159,665 A 2/1875 Gauthey
169,807 A 11/1875 Hart
462,611 A 11/1891 Comte De Sparre
498,856 A 6/1893 Overbaugh
640,856 A 1/1900 Bailey
662,137 A 11/1900 Tellerson
676,000 A 6/1901 Hennegerg
865,979 A 9/1907 Bailey
869,046 A 10/1907 Bailey
905,358 A 12/1908 Peters
957,171 A 5/1910 Loeb
963,911 A 7/1910 Loeble
1,060,817 A 5/1913 Clyne
1,940,657 A 1/1933 Woodford
2,294,822 A 9/1942 Albree
2,465,962 A 3/1949 Allen et al.
2,654,319 A 10/1953 Roske
2,823,611 A 2/1958 Thayer
2,862,446 A 12/1958 Ringdal
2,918,868 A 12/1959 Ringdal
3,099,958 A 8/1963 Daubenspeck et al.
3,170,401 A 2/1965 Johnson et al.
3,242,789 A 3/1966 Woodring
3,292,538 A 12/1966 Umbach et al.
3,485,170 A 12/1969 Scanlon
3,485,173 A 12/1969 Morgan
3,609,904 A 10/1971 Scanlon
3,659,528 A 5/1972 Santala
3,688,699 A 9/1972 Horn et al.
3,690,256 A 9/1972 Schnitzer
3,745,924 A 7/1973 Scanlon
3,749,021 A 7/1973 Scanlon
3,756,156 A 9/1973 Schuster
3,765,297 A 10/1973 Skochko et al.
3,768,413 A 10/1973 Ramsay
3,797,396 A 3/1974 Reed
3,842,739 A 10/1974 Scanlon et al.
3,866,536 A 2/1975 Greenberg
3,874,294 A 4/1975 Hale
3,955,506 A 5/1976 Luther et al.
3,977,326 A 8/1976 Anderson et al.
3,990,366 A 11/1976 Scanlon
4,020,763 A 5/1977 Iruretagoyena
4,147,107 A 4/1979 Ringdal
4,157,684 A 6/1979 Clausser
4,173,186 A 11/1979 Dunham
4,187,271 A 2/1980 Rolston et al.
4,228,724 A 10/1980 Leich
4,475,435 A 10/1984 Mantel
4,598,445 A 7/1986 O'Connor
4,614,157 A 9/1986 Grelle et al.
4,679,505 A 7/1987 Reed
4,718,348 A 1/1988 Ferrigno
4,719,859 A 1/1988 Ballreich et al.
4,726,296 A 2/1988 Leshner et al.
4,867,065 A 9/1989 Kaltmamm et al.
5,021,206 A 6/1991 Stoops
5,033,386 A 7/1991 Vatsvog
5,063,853 A 11/1991 Bilgeri
5,090,327 A 2/1992 Bilgeri
5,151,555 A 9/1992 Vatsvog
5,165,040 A 11/1992 Andersson et al.
5,237,930 A 8/1993 Belanger et al.
5,247,888 A 9/1993 Conil
5,259,288 A 11/1993 Vatsvog
5,265,540 A 11/1993 Ducros et al.
5,433,148 A 7/1995 Barratault et al.
5,535,495 A 7/1996 Gutowski
5,563,365 A 10/1996 Dineen et al.
5,770,815 A 6/1998 Watson, Jr.
5,798,478 A 8/1998 Beal
5,950,063 A 9/1999 Hens et al.
5,961,200 A 10/1999 Friis
5,969,288 A 10/1999 Baud
6,004,682 A 12/1999 Rackovan et al.
6,048,379 A 4/2000 Bray et al.
6,070,532 A 6/2000 Halverson
6,272,993 B1 8/2001 Cook et al.
6,283,035 B1 9/2001 Olson et al.
6,357,357 B1 3/2002 Glasser
6,375,971 B1 4/2002 Hansen
6,450,099 B1 9/2002 Desgland
6,460,464 B1 10/2002 Attarwala
6,523,476 B1 2/2003 Riess et al.
6,649,095 B2 11/2003 Buja
6,708,621 B1 3/2004 Forichon-Chaumet et al.
6,752,084 B1 6/2004 Husseini et al.
6,840,149 B2 1/2005 Beal
6,845,716 B2 1/2005 Husseini et al.
7,000,547 B2 2/2006 Amick
7,032,492 B2 4/2006 Meshirer
7,056,091 B2 6/2006 Powers
7,059,234 B2 6/2006 Husseini
7,165,496 B2 1/2007 Reynolds
7,204,191 B2 4/2007 Wiley et al.
7,213,519 B2 5/2007 Wiley et al.
7,232,473 B2 6/2007 Elliott
7,299,750 B2 11/2007 Schikora et al.
7,353,756 B2 4/2008 Leasure
7,380,505 B1 6/2008 Shiery
7,383,776 B2 6/2008 Amick
7,392,746 B2 7/2008 Hansen
7,441,504 B2 10/2008 Husseini et al.
7,585,166 B2 9/2009 Buja
7,610,858 B2 11/2009 Chung
7,750,091 B2 7/2010 Maljkovic et al.
7,841,279 B2 11/2010 Reynolds et al.
7,930,977 B2 4/2011 Klein
8,007,370 B2 8/2011 Hirsch et al.
8,056,232 B2 11/2011 Patel et al.
8,156,870 B2 4/2012 South
8,201,867 B2 4/2012 South
8,206,522 B2 6/2012 Sandstrom et al.
8,240,252 B2 8/2012 Maljkovic et al.
8,408,137 B2 4/2013 Battablia
8,443,730 B2 5/2013 Padgett
8,511,233 B2 8/2013 Nilsson
8,522,684 B2 9/2013 Davies et al.
8,540,828 B2 9/2013 Busky et al.
8,561,543 B2 10/2013 Burrow
8,573,126 B2 11/2013 Klein et al.
8,641,842 B2 2/2014 Hafner et al.
8,689,696 B1 4/2014 Seeman et al.
8,763,535 B2 7/2014 Padgett
8,790,455 B2 7/2014 Borissov et al.
8,807,008 B2 8/2014 Padgett et al.
8,813,650 B2 8/2014 Maljkovic et al.
D715,888 S 10/2014 Padgett
8,857,343 B2 10/2014 Marx
8,869,702 B2 10/2014 Padgett
8,875,633 B2 11/2014 Padgett
8,893,621 B1 11/2014 Escobar
8,978,559 B2 3/2015 Davies et al.
9,003,973 B1 4/2015 Padgett
9,032,855 B1 5/2015 Foren et al.
9,091,516 B2 7/2015 Davies et al.

(56) References Cited

U.S. PATENT DOCUMENTS

| | | | | |
|---|---|---|---|---|
| 9,103,641 | B2 | 8/2015 | Nielson et al. | |
| 9,170,080 | B2 | 10/2015 | Poore et al. | |
| 9,182,204 | B2 | 11/2015 | Maljkovic et al. | |
| 9,200,880 | B1 | 12/2015 | Foren et al. | |
| 9,212,876 | B1 | 12/2015 | Kotska et al. | |
| 9,212,879 | B2 | 12/2015 | Whitworth | |
| 9,213,175 | B2 | 12/2015 | Arnold | |
| 9,254,503 | B2 | 2/2016 | Ward | |
| 9,255,775 | B1 | 2/2016 | Rubin | |
| 9,329,004 | B2 | 5/2016 | Pace | |
| 9,335,137 | B2 | 5/2016 | Maljkovic et al. | |
| 9,337,278 | B1 | 5/2016 | Gu et al. | |
| 9,347,457 | B2 | 5/2016 | Ahrens et al. | |
| 9,366,512 | B2 | 6/2016 | Burczynski et al. | |
| 9,377,278 | B2 | 6/2016 | Rubin | |
| 9,389,052 | B2 | 7/2016 | Conroy et al. | |
| 9,395,165 | B2 | 7/2016 | Maljkovic et al. | |
| D764,624 | S | 8/2016 | Masinelli | |
| D765,214 | S | 8/2016 | Padgett | |
| 9,429,407 | B2 | 8/2016 | Burrow | |
| 9,441,930 | B2 | 9/2016 | Burrow | |
| 9,453,714 | B2 | 9/2016 | Bosarge et al. | |
| 9,528,799 | B2 | 12/2016 | Maljkovic et al. | |
| 9,546,849 | B2 * | 1/2017 | Burrow | F42B 5/307 |
| D778,391 | S | 2/2017 | Burrow | |
| D778,393 | S | 2/2017 | Burrow | |
| D778,394 | S | 2/2017 | Burrow | |
| D778,395 | S | 2/2017 | Burrow | |
| D779,024 | S | 2/2017 | Burrow | |
| 2001/0013299 | A1 | 8/2001 | Husseini et al. | |
| 2003/0101891 | A1 | 6/2003 | Amick | |
| 2003/0217665 | A1 | 11/2003 | Rennard | |
| 2004/0159262 | A1 | 8/2004 | LeaSure | |
| 2005/0005807 | A1 | 1/2005 | Wiley | |
| 2005/0016411 | A1 | 1/2005 | Amick | |
| 2005/0056183 | A1 | 3/2005 | Meshirer | |
| 2005/0188883 | A1 | 9/2005 | Husseini et al. | |
| 2005/0257711 | A1 | 11/2005 | Husseini et al. | |
| 2005/0257712 | A1 | 11/2005 | Husseini et al. | |
| 2005/0268808 | A1 | 12/2005 | Werner | |
| 2006/0027129 | A1 | 2/2006 | Kolb et al. | |
| 2006/0207464 | A1 | 9/2006 | Maljkovic et al. | |
| 2006/0283314 | A1 | 12/2006 | Cesaroni | |
| 2007/0214992 | A1 | 9/2007 | Dittrich | |
| 2007/0261587 | A1 | 11/2007 | Chung | |
| 2009/0183850 | A1 | 7/2009 | Morrison et al. | |
| 2009/0042057 | A1 | 12/2009 | Thomas et al. | |
| 2010/0016518 | A1 | 1/2010 | El-Hibri et al. | |
| 2010/0258023 | A1 | 10/2010 | Reynolds et al. | |
| 2010/0300319 | A1 | 12/2010 | Guindon | |
| 2010/0305261 | A1 | 12/2010 | Maljkovic et al. | |
| 2011/0016717 | A1 | 1/2011 | Morrison et al. | |
| 2011/0179965 | A1 | 7/2011 | Mason | |
| 2011/0226149 | A1 | 9/2011 | Tepe et al. | |
| 2012/0022418 | A1 | 2/2012 | Klein | |
| 2012/0024183 | A1 | 2/2012 | Klein | |
| 2012/0111219 | A1 * | 5/2012 | Burrow | F42B 5/307 102/467 |
| 2012/0152101 | A1 | 6/2012 | Engleman et al. | |
| 2012/0180687 | A1 | 7/2012 | Padgett et al. | |
| 2012/0180688 | A1 | 7/2012 | Padgett | |
| 2013/0014664 | A1 | 1/2013 | Padgett | |
| 2013/0180392 | A1 | 7/2013 | Nuetzman et al. | |
| 2013/0186294 | A1 * | 7/2013 | Davies | F42B 5/313 102/467 |
| 2014/0060372 | A1 | 3/2014 | Padgett | |
| 2014/0060373 | A1 | 3/2014 | Maljkovic et al. | |
| 2014/0076188 | A1 | 3/2014 | Maljkovic et al. | |
| 2014/0216293 | A1 | 8/2014 | Klein et al. | |
| 2014/0224144 | A1 | 8/2014 | Neugebauer | |
| 2014/0235784 | A1 | 8/2014 | Maljkovic et al. | |
| 2014/0260925 | A1 | 9/2014 | Beach et al. | |
| 2014/0261046 | A1 | 9/2014 | Marx | |
| 2014/0326157 | A1 | 11/2014 | Conroy | |
| 2014/0345488 | A1 | 11/2014 | Schluckebier et al. | |
| 2014/0373744 | A1 | 12/2014 | Padgett | |
| 2015/0007716 | A1 | 1/2015 | Macvicar et al. | |
| 2015/0033970 | A1 | 2/2015 | Maljkovic et al. | |
| 2015/0033990 | A1 | 2/2015 | Yeager | |
| 2015/0036058 | A1 | 2/2015 | Ng et al. | |
| 2015/0075400 | A1 | 3/2015 | Lemke et al. | |
| 2015/0219573 | A1 | 8/2015 | Lukay et al. | |
| 2015/0226220 | A1 | 8/2015 | Bevington | |
| 2015/0241183 | A1 | 8/2015 | Padgett et al. | |
| 2015/0241184 | A1 | 8/2015 | Burrow | |
| 2015/0260490 | A1 | 9/2015 | Burrow | |
| 2015/0260491 | A1 | 9/2015 | Burrow | |
| 2015/0260495 | A1 | 9/2015 | Burrow | |
| 2015/0330756 | A1 | 11/2015 | Ward | |
| 2015/0360587 | A1 | 12/2015 | Hoffmann et al. | |
| 2016/0003587 | A1 | 1/2016 | Burrow | |
| 2016/0003588 | A1 | 1/2016 | Burrow | |
| 2016/0003589 | A1 | 1/2016 | Burrow | |
| 2016/0003590 | A1 | 1/2016 | Burrow | |
| 2016/0003593 | A1 | 1/2016 | Burrow | |
| 2016/0003594 | A1 | 1/2016 | Burrow | |
| 2016/0003595 | A1 | 1/2016 | Burrow | |
| 2016/0003596 | A1 | 1/2016 | Burrow | |
| 2016/0003597 | A1 | 1/2016 | Burrow | |
| 2016/0003601 | A1 | 1/2016 | Burrow | |
| 2016/0033241 | A1 | 2/2016 | Burrow | |
| 2016/0033246 | A1 | 2/2016 | Burrow | |
| 2016/0102030 | A1 | 4/2016 | Coffey et al. | |
| 2016/0131464 | A1 | 5/2016 | Rubin | |
| 2016/0153757 | A1 | 6/2016 | Mahnke | |
| 2016/0161232 | A1 | 6/2016 | Rubin | |
| 2016/0238355 | A1 | 8/2016 | Dionne et al. | |
| 2016/0245626 | A1 | 8/2016 | Drieling et al. | |
| 2016/0265886 | A1 | 9/2016 | Aldrich et al. | |
| 2016/0273896 | A1 | 9/2016 | Emary | |
| 2016/0349022 | A1 | 12/2016 | Burrow | |
| 2016/0349023 | A1 | 12/2016 | Burrow | |
| 2016/0349028 | A1 | 12/2016 | Burrow | |
| 2016/0356581 | A1 | 12/2016 | Burrow | |
| 2016/0356588 | A1 | 12/2016 | Burrow | |
| 2016/0377399 | A1 | 12/2016 | Burrow | |
| 2017/0080498 | A1 | 3/2017 | Burrow | |
| 2017/0082409 | A1 * | 3/2017 | Burrow | F42B 5/30 |
| 2017/0082411 | A1 | 3/2017 | Burrow | |
| 2017/0089672 | A1 | 3/2017 | Burrow | |
| 2017/0089673 | A1 | 3/2017 | Burrow | |
| 2017/0089674 | A1 | 3/2017 | Burrow | |
| 2017/0089675 | A1 * | 3/2017 | Burrow | F42B 5/307 |
| 2017/0089679 | A1 | 3/2017 | Burrow | |

FOREIGN PATENT DOCUMENTS

| | | | |
|---|---|---|---|
| EP | 2625486 | A1 | 8/2013 |
| GB | 783023 | | 9/1957 |
| WO | 2000034732 | | 6/2000 |
| WO | 2007014024 | A2 | 2/2007 |
| WO | 2012047615 | A1 | 4/2012 |
| WO | 2012097317 | A2 | 7/2012 |
| WO | 2012097320 | A1 | 7/2012 |
| WO | 2013070250 | A1 | 5/2013 |
| WO | 2013096848 | A1 | 6/2013 |
| WO | 2014062256 | A2 | 4/2014 |
| WO | 2016003817 | A1 | 1/2016 |

OTHER PUBLICATIONS

Korean Intellectual Property Office (ISA), International Search Report and Written Opinion for PCT/US2015/038061 dated Sep. 21, 2015, 28 pp.

accurateshooter.com Daily Bulletin "New PolyCase Ammunication and Injection-Molded Bullets" Jan. 11, 2015.

* cited by examiner

METHOD OF MAKING A POLYMERIC SUBSONIC AMMUNITION CARTRIDGE

CROSS-REFERENCE TO RELATED APPLICATIONS

This application is a Continuation-in-Part of U.S. application Ser. No. 14/011,202 entitled "Lightweight Polymer Ammunition Cartridge Casings" filed on Aug. 27, 2013, which is a Divisional of U.S. patent application Ser. No. 13/292,843 entitled "Lightweight Polymer Ammunition Cartridge Casings" filed on Nov. 9, 2011 which issued as U.S. Pat. No. 8,561,543 on Oct. 22, 2013, which claims priority to U.S. Provisional Application Ser. No. 61/456,664 entitled "Polymer Case Ammunition and Methods of Manufacturing the Same (diffuser and exacter insert)" filed on Nov. 10, 2010. The contents of which are incorporated by reference in their entirety.

TECHNICAL FIELD OF THE INVENTION

The present invention generally relates to ammunition articles, and more particularly to methods of making subsonic ammunition casings formed from polymeric materials.

STATEMENT OF FEDERALLY FUNDED RESEARCH

Not applicable.

INCORPORATION-BY-REFERENCE OF MATERIALS FILED ON COMPACT DISC

Not applicable.

BACKGROUND OF THE INVENTION

Without limiting the scope of the invention, its background is described in connection with lightweight polymer subsonic ammunition casing and more specifically to a lightweight polymer subsonic ammunition casing having a propellant insert positioned in the propellant chamber to reduce the internal volume of the propellant chamber.

Generally, there are two types of ammunition: supersonic ammunition, which fires projectiles with velocities exceeding the speed of sound; and subsonic ammunition, which fires projectiles with velocities less than that of the speed of sound and generally in the range of 1,000-1,100 feet per second (fps), most commonly given at 1,086 fps at standard atmospheric conditions. Traditional methods of making subsonic ammunition reduce the propellant charge (and in turn increasing the empty volume left vacant by the reduced propellant charge) in the shell until the velocity is adequately reduced.

Unfortunately, this empty volume can cause numerous problems including inhibition of proper propellant burn, inconsistent propellant positioning, reduced accuracy and propellant detonation caused by extremely high propellant burn rates. For example, since the propellant is free to move in the large empty volume, shooting downward with the propellant charge away from the primer gives different velocity results than when shooting upwards with the propellant charge close to the primer. Finally, usage of subsonic ammunition, and its attending lower combustion pressures, frequently results in the inability to efficiently cycle semi-automatic or fully automatic weapons where the propellant charge must produce sufficient gas pressure and/or volume to accelerate the projectile and to cycle the firing mechanism. With a reduced quantity of propellant, subsonic ammunition generally fails to produce sufficient pressure to properly cycle the firing mechanism. The art has provided numerous attempts to cure these problems, e.g., the introduction of inert fillers, expandable inner sleeves that occupy the empty space between the propellant and the projectile, insertion of flexible tubing, foamed inserts, stepped down stages in the discharge end of cartridge casings, or complicated three and more component cartridges with rupturable walls and other complicated features. Another approach has been to use standard cartridges in combination with non-standard propellants. However, the result of such prior attempts to solve the production of reliable subsonic cartridges have failed and let to subsonic rounds that have a larger variation in velocity and variance in accuracy potential.

In addition the use of polymer ammunition results in additional drawbacks, e.g., the possibility of the projectile being pushed into the cartridge casing, the bullet pull being too light such that the bullet can fall out, the bullet pull being too insufficient to create sufficient chamber pressure, the bullet pull not being uniform from round to round, and portions of the cartridge casing breaking off upon firing causing the weapon to jam or damage or danger when subsequent rounds are fired or when the casing portions themselves become projectiles. Accordingly, a need exists to develop solutions that make it possible to manufacture better and more price competitive subsonic ammunition than previously available.

SUMMARY OF THE INVENTION

The present invention provides a method of preparing a polymeric subsonic ammunition by providing a substantially cylindrical primer insert comprising a base having a top surface opposite a bottom surface, a substantially cylindrical coupling flange that extends from the top surface forming a substantially cylindrical inner surface, a substantially cylindrical primer wall that extends from the bottom surface wherein a substantially cylindrical primer recess is formed by the inner surface of the substantially cylindrical primer wall and a groove formed on the circumference of an outer surface of the substantially cylindrical primer wall, wherein the substantially cylindrical inner surface is opposite the substantially cylindrical primer recess, and a primer aperture formed through the base to connect the substantially cylindrical inner surface to the substantially cylindrical primer recess; forming a substantially cylindrical polymeric middle body having the substantially cylindrical primer insert at a first end and a substantially cylindrical polymeric coupling region at a second end by contacting a polymeric material with the substantially cylindrical primer insert, wherein the polymeric material covers the substantially cylindrical coupling flange and extends over the substantially cylindrical inner surface to form a primer flash hole and extends over the outer surface of the substantially cylindrical primer wall to the groove; wherein a propellant chamber extends from the substantially cylindrical polymeric coupling region to the primer flash hole; coupling a substantially cylindrical polymeric bullet-end component to the substantially cylindrical polymeric middle body, wherein the substantially cylindrical polymeric bullet-end component comprises a substantially cylindrical polymeric coupling end opposite a bullet aperture, wherein the substantially cylindrical polymeric coupling end mates to the substantially cylindrical polymeric coupling region and extends the propellant chamber from the bullet aperture to the primer flash hole; and positioning a propellant insert in the propellant chamber to reduce the internal volume of the propellant chamber, wherein the propellant chamber has an internal volume that is between 25 and 80% less than the open internal volume of a standard casing of equivalent caliber. The internal volume may be about 25.1, 25.2, 25.3, 25.4, 25.5, 25.6, 25.7, 25.8, 25.9, 26.0, 26.25, 26.5, 26.75, 27, 27.5, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, or 80% (and incremental variations thereof) less than the open internal volume of a standard casing of equivalent caliber.

The substantially cylindrical polymeric bullet-end component may include a shoulder positioned between the substantially cylindrical polymeric coupling end and the bullet aperture. The substantially cylindrical primer insert may include a flash hole groove formed about the primer aperture on the bottom surface and the polymer extends over the substantially cylindrical inner surface to the flash hole groove to form a primer flash hole. The propellant chamber may contain a propellant volume such that a projectile does not exceed a velocity of 1,200 feet per second at sea level under standard atmospheric conditions when fired. The propellant chamber contains a propellant volume such that a projectile does not exceed the velocity of 1,086 feet per second at standard atmospheric conditions when fired. The method further includes the step of securing a projectile to the bullet aperture by a mechanical interference, adhesive, ultrasonic welding, the combination of molding in place and adhesive, or hot crimping after molding. The substantially cylindrical polymeric middle body, the substantially cylindrical polymeric bullet-end component and the propellant insert independently may include a material selected from the group consisting of polyphenylsulfone, polycarbonate, and polyamide. The substantially cylindrical polymeric middle body, the substantially cylindrical polymeric bullet-end component and the propellant insert may independently include at least one additive selected from the group consisting of plasticizers, lubricants, molding agents, fillers, thermo-oxidative stabilizers, flame-retardants, coloring agents, compatibilizers, impact modifiers, release agents, reinforcing fibers and reinforcing agents. The propellant insert may include a substantially cylindrical shape. The propellant insert may include a free formed shape. The propellant insert may include a one or more ribs extending into the propellant chamber. The propellant insert may include a radial cross-section selected from the group consisting of circular, ovoid, octagonal, hexagonal, triangular, star, ribbed, square and a combination thereof. The radial cross-section of the propellant chamber may be irregular along its longitudinal length. The radial size of the propellant chamber tapers along its longitudinal direction. The polymeric casing body and propellant insert may be formed of different polymeric materials. The substantially cylindrical polymeric middle body, the substantially cylindrical polymeric bullet-end component and the propellant insert may independently comprise the same polymeric material. The substantially cylindrical polymeric middle body, the substantially cylindrical polymeric bullet-end component and the propellant insert independently may be different polymeric materials. The propellant chamber may be formed of a separate propellant insert disposed within the internal cavity of the generally cylindrical hollow polymer body.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
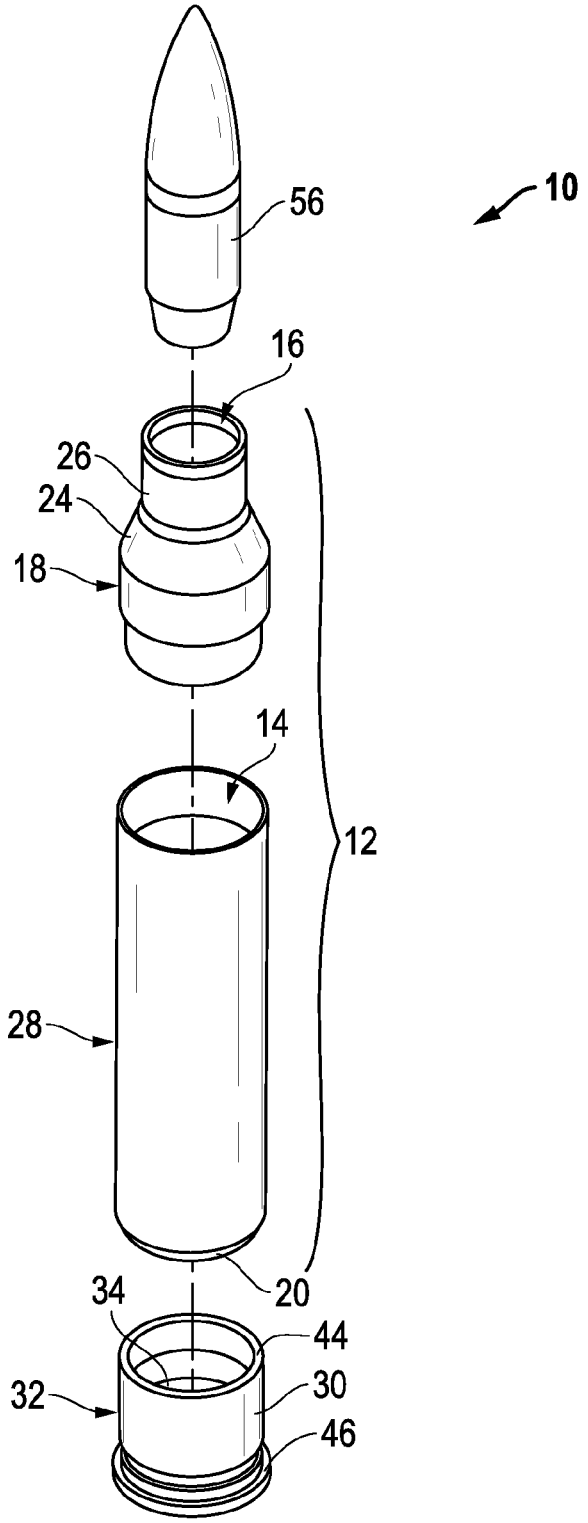
FIG. 1 depicts an exploded view of the polymeric cartridge casing.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

As used herein, the term "ammunition", "ammunition article", "munition", and "munition article" as used herein may be used interchangeably to refer to a complete, assembled round or cartridge of that is ready to be loaded into a firearm and fired, including cap, casing, propellant, projectile, etc. Ammunition may be a live round fitted with a projectile, or a blank round with no projectile and may also be other types such as non-lethal rounds, rounds containing rubber bullets, rounds containing multiple projectiles (shot), and rounds containing projectiles other than bullets such as fluid-filled canisters and capsules. Ammunition may be any caliber of pistol or rifle ammunition, e.g., non limiting examples including .22, .22-250, .223, .243, .25-06, .270, .300, .30-30, .30-40, 30.06, .300, .303, .308, .338, .357, .38, .380, .40, .44, .45, .45-70, .50 BMG, caliber ammunition cartridges, as well as medium/small caliber ammunition such as including 5.45 mm, 5.56 mm, 6.5 mm, 6.8 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm, 460 mm, 8 inch, 4.2 inch, 45 caliber and the like and military style ammunition.

As used herein, the term "subsonic ammunition" refers to ammunition that ejects a projectile at velocities of less than the speed of sound at standard atmospheric conditions, e.g., generally in the range of 1,000-1,100 feet per second (fps) but may range from 900-1,200 feet per second (fps) depending on the altitude and atmospheric conditions. Specific examples include about 1000 fps, 1010 fps, 1020 fps, 1030 fps, 1040 fps, 1050 fps, 1060 fps, 1070 fps, 1080 fps, 1086 fps, 1090 fps, and even 1099 fps.

As used herein, the term "casing" and "case" and "body" are used interchangeably (e.g., "cartridge casing", "cartridge case" and "casing body") to refer to the portion of the ammunition that remains intact after firing and includes the propellant chamber and may include the primer insert. A cartridge casing may be one-piece, two-piece, three piece or multi-piece design that includes a mouth at one end and a primer insert at the other separated by a propellant chamber.

A traditional cartridge casing generally has a deep-drawn elongated body with a primer end and a projectile end. During use, a weapon's cartridge chamber supports the majority of the cartridge casing wall in the radial direction, however, in many weapons, a portion of the cartridge base end is unsupported. During firing, the greatest stresses are concentrated at the base end of the cartridge, which must have great mechanical strength. This is true for both subsonic and supersonic ammunition cartridges.

There is a need for a subsonic polymer ammunition cartridge to reduce cost, weight and reliability. The traditional avenue to subsonic ammunition is usage of a reduced quantity of propellant compared to traditional supersonic ammunition. For example, a traditional 7.62 mm ammunition uses about 45 grains of propellant and generates projectile velocities of 2000-3000 fps, a subsonic ammunition uses less than about 15 grains of propellant to generate projectile velocities of less than 1100 fps. The present inventors determined that a subsonic cartridge casing may be produced by the design and construction of an engineered internal propellant chamber within the overall internal volume of the casing. The internal propellant chamber positioned within the casing may be in the form of a propellant chamber insert that is made separately and inserted into the chamber. Alternatively the propellant chamber insert may be made as a part of the middle body component and the propellant chamber by increasing the thickness of the side wall. The propellant chamber insert will function to reduce the size of the propellant chamber which will reduce the amount of propellant in the propellant chamber and in turn reduce the velocity of the projectile. In particular, the propellant chamber insert reduces the internal volume of the propellant chamber by more than 25% or 80% compared to the equivalent supersonic casing of the same caliber. In addition, using such a propellant chamber insert allows the internal propellant chamber of existing ammunition cartridge casings to be used allowing ammunition manufacturer to assemble the cartridge casing in a rapid fashion without the need for additional manufacturing steps or complex design parameters.

The propellant chamber insert when in the form of an integral portion of the cartridge casing is constructed out of the same polymer composition as the cartridge casing. When the propellant chamber insert is a separate insert positioned within the propellant chamber, the propellant chamber insert may be of a similar or a different polymer composition than the cartridge casing. It will also be recognized that in any of the embodiments described herein, the outer wall and inner volume occupying portions of the cartridge casing need not necessarily be of the same polymeric material. For example, the outer wall could be made of polymers with higher temperature resistance to resist the hot chamber conditions, while the inner volume occupying portion could be manufactured out of low cost polymers or be made with voids or ribs to reduce the amount of material used. In one embodiment, the space defined between the outer wall and the propellant chamber includes voids or ribs. In another embodiment, the propellant chamber comprises multiple separate internal volumes each in combustible communication with the primer. In still yet another such embodiment, the propellant chamber has a radial cross-section selected from the group consisting of circular, ovoid, octagonal, hexagonal, triangular, and square. In one embodiment, the radial cross-section of the propellant chamber is irregular along its longitudinal length. In another embodiment, the radial size of the propellant chamber tapers along its longitudinal direction. In another embodiment, the propellant chamber has a radial cross-section selected from the group consisting of circular, ovoid, octagonal, hexagonal, triangular, and square. In one such embodiment, the radial cross-section of the propellant chamber is irregular along its longitudinal length. In another such embodiment, the radial size of the propellant chamber tapers along its longitudinal direction.

One skilled in the art will also readily observe that different or identical coloring of the polymers used could aid in identification or marketing of the ammunition of the current invention. Another embodiment of this invention would be the usage of transparent or translucent polymers, allowing for easy identification of the propellant level or cartridge load.

For example, a non-limiting list of suitable polymeric materials, for both the cartridge casing and the propellant chamber insert may be selected from any number of polymeric materials and individual monomers of a copolymer include, e.g., polybutylene terephthalates, polyamides, polyimides, polyesters, polycarbonates, polysulfones, polylactones, polyacetals, acrylontrile/butadiene/styrene copolymer resins, polyphenylene oxides, ethylene/carbon monoxide copolymers, polyphenylene sulfides, polystyrene, styrene/acrylonitrile copolymer resins, styrene/maleic anhydride copolymer resins, aromatic polyketones and mixtures thereof. Preferred embodiments will be manufactured from any polymer with a glass transition temperature of less than 250° C. Particularly suitable materials include polyphenylsulfones, polycarbonates and polyamides.

FIG. 1 depicts an exploded view of the polymeric cartridge casing. A cartridge 10 is shown with a polymer casing 12 showing a powder chamber 14 with a forward end opening 16 for insertion of a projectile (not shown). Polymer casing 12 has a substantially cylindrical open-ended polymeric bullet-end 18 extending from forward end opening 16 rearward to opposite end 20. The bullet-end component 18 may be formed with coupling end 22 formed on end 20. Coupling end 22 is shown as a female element, but may also be configured as a male element in alternate embodiments of the invention. The forward end of bullet-end component 18 has a shoulder 24 forming chamber neck 26. Polymer casing 12 has a substantially cylindrical opposite end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. The substantially cylindrical insert 32 also has a flange 46 cut therein and a primer recess 38 and primer flash aperture formed therein for ease of insertion of the primer (not shown). A primer flash hole aperture 42 is located in the primer recess 38 and extends through the bottom surface 34 into the propellant chamber 14 to combust the propellant in the propellant chamber 14. When molded the coupling end 22 extends the polymer through the primer flash hole aperture 42 to form the primer flash hole 40 while retaining a passage from the top surface 36 through the bottom surface 34 and into the propellant chamber 14 to provide support and protection about the primer flash hole aperture 42.

The polymeric and composite casing components may be injection molded. Polymeric materials for the bullet-end and middle body components must have propellant compatibility and resistance to gun cleaning solvents and grease, as well as resistance to chemical, biological and radiological agents. The polymeric materials must have a temperature resistance higher than the cook-off temperature of the propellant, typically about 320° F. The polymeric materials must have elongation-to-break values that to resist deformation under interior ballistic pressure as high as 60,000 psi in all environments (temperatures from about −65 to about 320° F. and humidity from 0 to 100% RH). According to one embodiment, the middle body component is either molded onto or snap-fit to the casing head-end component after which the bullet-end component is snap-fit or interference fit to the middle body component. The components may be formed from high-strength polymer, composite or ceramic.

Examples of suitable high strength polymers include composite polymer material including a tungsten metal powder, nylon 6/6, nylon 6, and glass fibers; and a specific gravity in a range of 3-10. The tungsten metal powder may be 50%-96% of a weight of the bullet body. The polymer material also includes about 0.5-15%, preferably about 1-12%, and most preferably about 2-9% by weight, of nylon 6/6, about 0.5-15%, preferably about 1-12%, and most preferably about 2-9% by weight, of nylon 6, and about 0.5-15%, preferably about 1-12%, and most preferably about 2-9% by weight, of glass fibers. It is most suitable that each of these ingredients be included in amounts less than 10% by weight. The cartridge casing body may be made of a modified ZYTEL® resin, available from E.I. DuPont De Nemours Co., a modified 612 nylon resin, modified to increase elastic response.

Commercially available polymers suitable for use in the present invention thus include polyphenylsulfones; copolymers of polyphenylsulfones with polyether-sulfones or polysulfones; copolymers and blends of polyphenylsulfones with polysiloxanes; poly(etherimide-siloxane); copolymers and blends of polyetherimides and polysiloxanes, and blends of polyetherimides and poly(etherimide-siloxane) copolymers; and the like. Particularly preferred are polyphenylsulfones and their copolymers with poly-sulfones or polysiloxane that have high tensile strength and elongation-to-break to sustain the deformation under high interior ballistic pressure. Such polymers are commercially available, for example, RADEL® R5800 polyphenylesulfone from Solvay Advanced Polymers. The polymer can be formulated with up to about 10 wt % of one or more additives selected from internal mold release agents, heat stabilizers, anti-static agents, colorants, impact modifiers and UV stabilizers.

Examples of suitable polymers include polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, or urethane hybrids. Examples of suitable polymers also include aliphatic or aromatic polyamide, polyeitherimide, polysulfone, polyphenylsulfone, poly-phenylene oxide, liquid crystalline polymer and polyketone. Examples of suitable composites include polymers such as polyphenylsulfone reinforced with between about 30 and about 70 wt %, and preferably up to about 65 wt % of one or more reinforcing materials selected from glass fiber, ceramic fiber, carbon fiber, mineral fillers, organo nanoclay, or carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components. Composite components can be formed by machining or injection molding. Finally, the cartridge case must retain sufficient joint strength at cook-off temperatures. More specifically, polymers suitable for molding of the projectile-end component have one or more of the following properties: Yield or tensile strength at −65° F.>10,000 psi Elongation-to-break at −65° F.>15% Yield or tensile strength at 73° F.>8,000 psi Elongation-to-break at 73° F.>50% Yield or tensile strength at 320° F.>4,000 psi Elongation-to-break at 320° F.>80%. Polymers suitable for molding of the middle-body component have one or more of the following properties: Yield or tensile strength at −65° F.>10,000 psi Yield or tensile strength at 73° F.>8,000 psi Yield or tensile strength at 320° F.>4,000 psi.

In one embodiment, the polymeric material additionally includes at least one additive selected from plasticizers, lubricants, molding agents, fillers, thermo-oxidative stabilizers, flame-retardants, coloring agents, compatibilizers, impact modifiers, release agents, reinforcing fibers. In still another such embodiment, the polymeric material comprises a material selected from the group consisting of polyphenylsulfone, polycarbonate, and polyamide. In such an embodiment, the polymeric material may include a translucent or transparent polymer. In another such embodiment, the polymeric material may include a polymeric material possessing a glass transition temperature of less than 250° C.

The polymers of the present invention can also be used for conventional two-piece metal-plastic hybrid cartridge case designs and conventional shotgun shell designs. One example of such a design is an ammunition cartridge with a one-piece substantially cylindrical polymeric cartridge casing body with an open projectile-end and an end opposing the projectile-end with a male or female coupling element; and a cylindrical metal cartridge casing head-end component with an essentially closed base end with a primer hole opposite an open end having a coupling element that is a mate for the coupling element on the opposing end of the polymeric cartridge casing body joining the open end of the head-end component to the opposing end of the polymeric cartridge casing body. The high polymer ductility permits the casing to resist breakage.

Figure 2A:
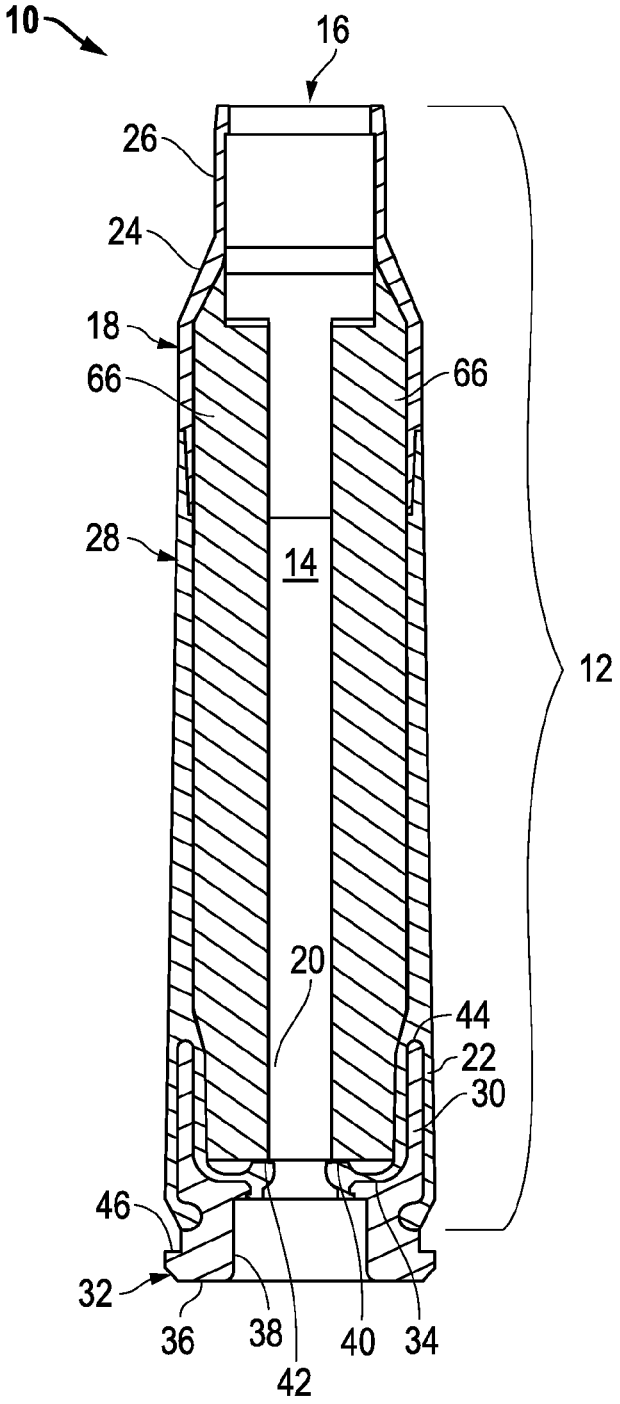
FIGS. 2A, 2B and 2C depict a cross-sectional view of a polymeric cartridge case having a reduced propellant chamber volume according to the present invention.
Figure 2B:
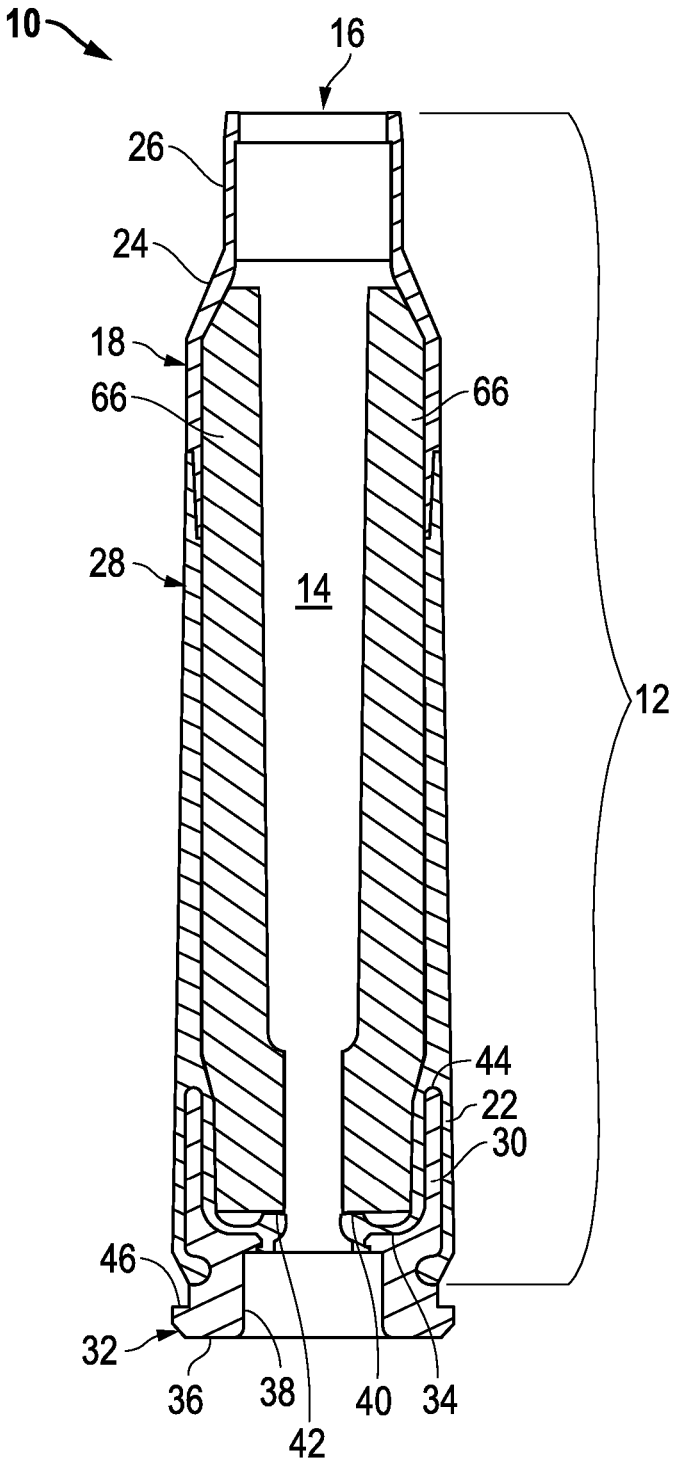
Figure 2C:
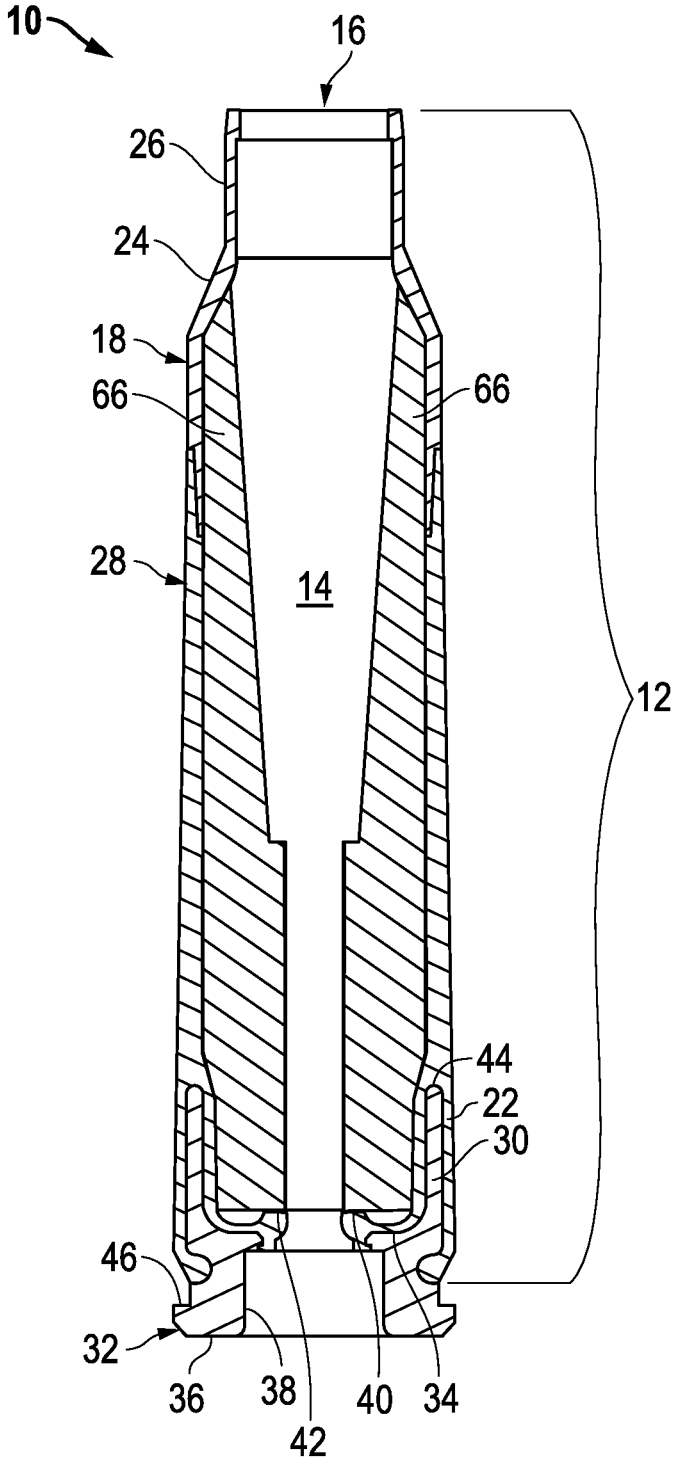

FIGS. 2A, 2B and 2C depict a cross-sectional view of a polymeric cartridge case according to one embodiment of the present invention. The present invention is not limited to the described caliber and is believed to be applicable to other calibers as well. This includes various small and medium caliber munitions, including 5.56 mm, 7.62 mm and .50 caliber ammunition cartridges, as well as medium/small caliber ammunition such as 380 caliber, 38 caliber, 9 mm, 10 mm, 20 mm, 25 mm, 30 mm, 40 mm, 45 caliber and the like. The cartridges, therefore, are of a caliber between about 0.05 and about 5 inches. Thus, the present invention is applicable to the military industry as well as the sporting goods industry for use by hunters and target shooters.

A cartridge casing 10 suitable for use with high velocity rifles is shown manufactured with a casing 12 showing a propellant chamber 14 with a projectile (not shown) inserted into the forward end opening 16. The cartridge casing 12 has a substantially cylindrical open-ended bullet-end component 18 extending from the forward end opening 16 rearward to the opposite end 20. The forward end of bullet-end component 18 has a shoulder 24 forming a chamber neck 26. The bullet-end component 18 may be formed with coupling end 22 formed on substantially cylindrical opposite end 20 or formed as a separate component. These and other suitable methods for securing individual pieces of a two-piece or multi-piece cartridge casing are useful in the practice of the present invention. Coupling end 22 is shown as a female element, but may also be configured as a male element in alternate embodiments of the invention. The forward end of bullet-end component 18 has a shoulder 24 forming chamber neck 26. The bullet-end component typically has a wall thickness between about 0.003 and about 0.200 inches and more preferably between about 0.005 and more preferably between about 0.150 inches about 0.010 and about 0.050 inches.

The middle body component 28 is substantially cylindrical and connects the forward end of bullet-end component 18 to the substantially cylindrical opposite end 20 and forms the propellant chamber 14. The substantially cylindrical opposite end 20 includes a substantially cylindrical insert 32 that partially seals the propellant chamber 14. The substantially cylindrical insert 32 includes a bottom surface 34 located in the propellant chamber 14 that is opposite a top surface 36. The substantially cylindrical insert 32 includes a primer recess 38 positioned in the top surface 36 extending toward the bottom surface 34 with a primer flash hole aperture 42 is located in the primer recess 38 and extends through the bottom surface 34 into the propellant chamber 14 to combust the propellant in the propellant chamber 14. A primer (not shown) is located in the primer recess 38 and extends through the bottom surface 34 into the propellant chamber 14. When molded the coupling end 22 extends the polymer through the primer flash hole aperture 42 to form the primer flash hole 40 while retaining a passage from the top surface 36 through the bottom surface 34 and into the propellant chamber 14 to provide support and protection about the primer flash hole aperture 42. The bullet-end 18, middle body 28 and bottom surface 34 define the interior of propellant chamber 14 in which the powder charge (not shown) is contained. The interior volume of propellant chamber 14 may be varied to provide the volume necessary for complete filling of the propellant chamber 14 by the propellant chosen so that a simplified volumetric measure of propellant can be utilized when loading the cartridge. The propellant chamber 14 includes a propellant chamber insert 66 that extends from the bottom surface 34 to the shoulder 24. The thickness of the propellant chamber insert 66 may be defined as the distance from the propellant chamber 14 to the interior of the middle body component 28 and may be varied as necessary to achieve the desired velocity depending on the propellant used. The propellant chamber 14 includes a propellant chamber insert 66 that extends from the bottom surface 34 to the shoulder 24 at a graduated distance from the propellant chamber 14 to the interior of the middle body component 28. For example, FIG. 2B shows a propellant chamber insert 66 that is thicker in the bottom of the propellant chamber 14 and thinner at the near the bullet-end 18. FIG. 2C shows a propellant chamber insert 66 that is thicker in the bottom of the propellant chamber 14 extending about half of the middle body component 28 and thinner at the near the bullet-end component 18 with the propellant chamber insert 66 tapering from towards the bullet-end 18. The propellant chamber insert 66 may be made of the same material as the casing or a different material. The propellant chamber insert 66 may be formed by extending the casing wall or may be made by separately forming an insert (not shown) that is inserted into the propellant chamber 14 during assembly.

The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 of bullet-end component 18 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 extends through the bottom surface 34 into the propellant chamber 14. The coupling end 22 extends the polymer through the primer flash hole aperture 42 to form an primer flash hole 40 while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component extends from a forward end opening 16 to coupling element 22. The middle body component typically has a wall thickness between about 0.003 and about 0.200 inches and more preferably between about 0.005 and more preferably between about 0.150 inches about 0.010 and about 0.050 inches.

The substantially cylindrical insert 32 also has a flange 46 cut therein and a primer recess 38 formed therein for ease of insertion of the primer (not shown). The primer recess 38 is sized so as to receive the primer (not shown) in a friction fit during assembly. The cartridge casing 12 may be molded from a polymer composition with the middle body component 28 being over-molded onto the substantially cylindrical insert 32. When over-molded the coupling end 22 extends the polymer through the primer flash hole aperture 42 to form the primer flash hole 40 while retaining a passage from the top surface 36 through the bottom surface 34 and into the propellant chamber 14 to provide support and protection about the primer flash hole aperture 42. The primer flash hole 40 communicates through the bottom surface 34 of substantially cylindrical insert 32 into the propellant chamber 14 so that upon detonation of primer (not shown) the propellant (not shown) in propellant chamber 14 will be ignited. The bullet-end component 18 and middle body component 28 can be welded or bonded together using solvent, adhesive, spin-welding, vibration-welding, ultrasonic-welding or laser-welding techniques. Other possible securing methods include, but are not limited to, mechanical interlocking methods such as over molding, press-in, ribs and threads, adhesives, molding in place, heat crimping, ultrasonic welding, friction welding etc.

Figure 3:
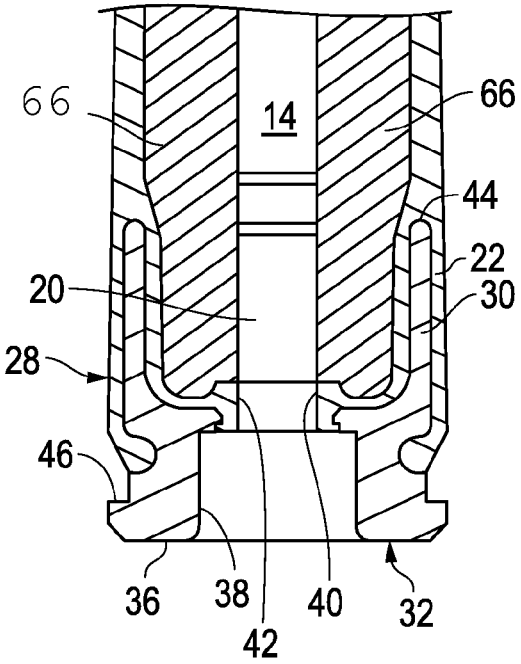
FIG. 3 depicts a cross-sectional view of a portion of the polymeric cartridge case having a reduced propellant chamber volume according to one embodiment of the present invention.

FIG. 3 depicts cross-sectional view of a portion of the polymeric cartridge case according to one embodiment of the present invention. A portion of a cartridge suitable for use with high velocity rifles is shown with a polymer casing 12 showing a propellant chamber 14. The polymer casing 12 has a substantially cylindrical opposite end 20. The bullet-end component 18 may be formed with coupling end 22 formed on end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element; however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. The propellant chamber 14 includes a propellant chamber insert 66 that extends from the bottom surface 34 to the shoulder 24. The thickness of the propellant chamber insert 66 may be defined as the distance from the propellant chamber 14 to the interior of the middle body component 28 and may be varied as necessary to achieve the desired volume to produce the desired velocity depending on the propellant used. The propellant chamber insert 66 may be made of the same material as the casing or a different material. The propellant chamber insert 66 may be formed by extending the casing wall or may be made by forming a separate insert that is formed and then inserted into the propellant chamber 14 during assembly. Located in the top surface 36 is a primer recess 38 that extends toward the bottom surface 34. A primer flash hole 40 is located in the primer recess 28 and extends through the bottom surface 34 into the propellant chamber 14. The coupling end 22 extends the polymer through the flash hole aperture 42 to form a primer flash hole 40 while retaining a passage from the top surface 36 through the bottom surface 34 and into the propellant chamber 14 to provide support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28.

FIGS. 4A-4H depict a top view of the polymer casing 12 with a substantially cylindrical open-ended middle body component 28. The polymer casing 12 includes a propellant chamber insert 66 positioned in the powder (propellant) chamber 14. The propellant chamber insert 66 may be molded as part of the outer wall of the polymer casing 12 or may be formed (e.g., molded, milled, etc.) as a separate insert that is formed and positioned separately in the powder (propellant) chamber 14. Visible is the primer flash hole 40 which extends through the bottom surface 34 to connect the primer (not shown) to the propellant chamber 14. The propellant chamber insert 66 may be of any shape or profile to occupy the necessary volume in the powder (propellant) chamber 14. In addition having any profile, the present invention may have a varied profile throughout the casing which allows the shoulder region to have a greater volume than the base region or to have a multistage propellant load. In addition, the propellant chamber insert 66 may have separate profiles in separate regions to achieve a specific burn and specific ignition.

Figure 5:
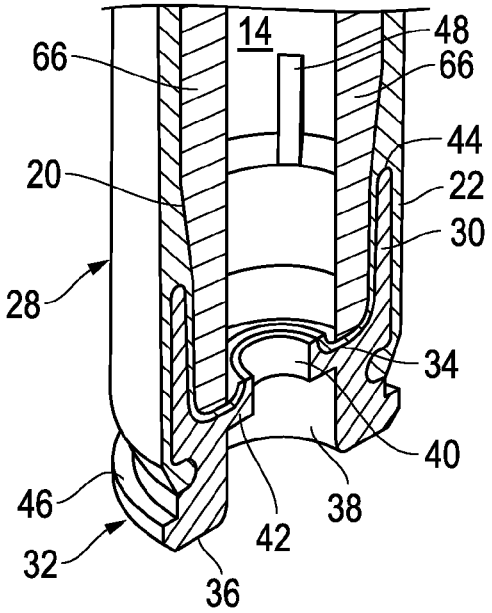
FIG. 5 depicts a side, cross-sectional view of a portion of the polymeric cartridge case displaying ribs and a reduced propellant chamber volume according to one embodiment of the present invention.
Figure 4A:
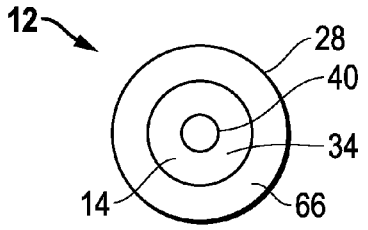
FIGS. 4A-4H depict a top view of the polymer casing having a reduced propellant chamber volume with a substantially cylindrical open-ended middle body component.
Figure 4B:
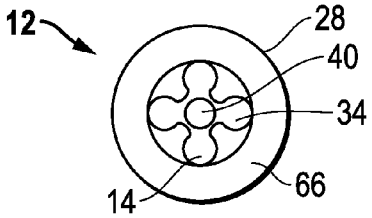
Figure 4C:
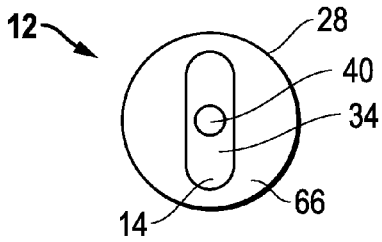
Figure 4D:
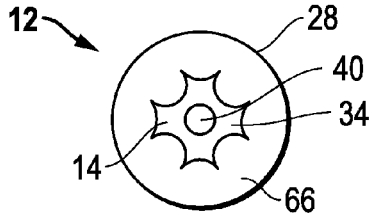
Figure 4E:
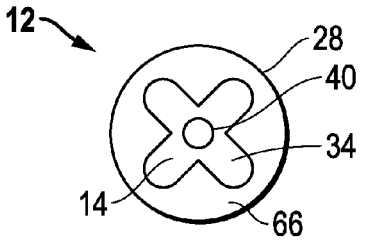
Figure 4F:
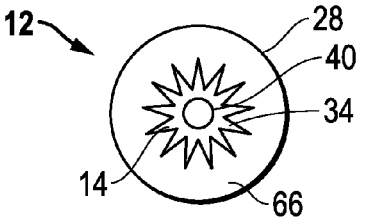
Figure 4G:
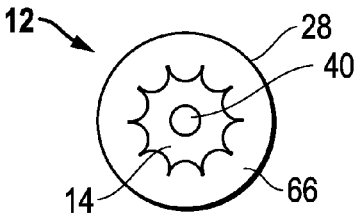
Figure 4H:
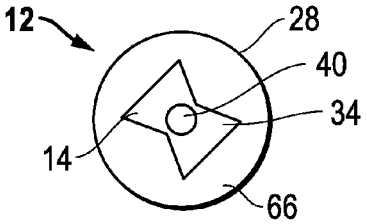

FIG. 5 depicts a side, cross-sectional view of a portion of the polymeric cartridge case displaying ribs according to one embodiment of the present invention. The polymer casing 12 has a substantially cylindrical opposite end 20. The bullet-end component 18 may be formed with coupling end 22 formed on substantially cylindrical opposite end 20. Coupling end 22 is shown as a female element, but may also be configured as a male element in alternate embodiments of the invention. The middle body component (not shown) is connected to a substantially cylindrical coupling element 30 of the substantially cylindrical insert 32. The substantially cylindrical insert 32 may be integrated into the polymer casing 12 by over-molded of the polymer, this process is known to the skilled artisan. The substantially cylindrical insert 32 may also be pressed into an insert aperture in the polymer casing 12. The substantially cylindrical insert 32 may be affixed to the insert aperture using solvent, adhesive, spin-welding, vibration-welding, ultrasonic-welding or laser-welding techniques. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30, extending from a bottom surface 34 that is opposite a top surface 36. Located in the top surface 36 is a primer recess 38 that extends toward the bottom surface 34. A flash hole aperture 42 extends through the bottom surface 34 into the propellant chamber 14. The coupling end 22 extends the polymer through the flash hole aperture 42 to form a primer flash hole 40 while retaining a passage from the top surface 36 through the bottom surface 34 and into the propellant chamber 14 to provide support and protection about the primer flash hole 40. The propellant chamber 14 includes a propellant chamber insert 66 that extends from the bottom surface 34 to the shoulder 24. The thickness of the propellant chamber insert 66 may be defined as the distance from the propellant chamber 14 to the interior of the middle body component 28 and may be varied as necessary to achieve the desired volume in the propellant camber 66 to achieve the desired velocity depending on the propellant used. The propellant chamber insert 66 may be made of the same material as the casing or a different material. The propellant chamber insert 66 may be formed by extending the casing wall or may be made by forming a separate insert that is formed and then inserted into the propellant chamber 14 during assembly. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The substantially cylindrical opposite end 20 or anywhere within the propellant chamber 14 may include one or more ribs 48 on the surface. The number of ribs 48 will depend on the specific application and desire of the manufacture but may include 1, 2, 3, 4, 5 6, 7, 8, 9, 10, or more ribs. In the counter bore, the polymer was having difficulty filling this area due to the fact that the polymer used has fillers in it, and needed to be reblended during molding. One embodiment includes six ribs 48 to create turbulence in the flow of the polymer, thus allowing the material to fill the counter bore.

Figure 6:
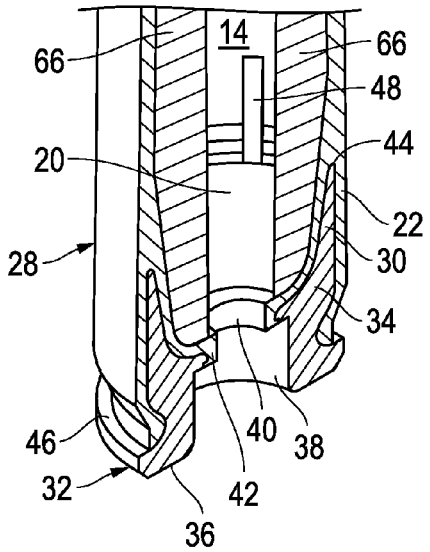
FIG. 6 depicts a side, cross-sectional view of a portion of the polymeric cartridge case having a reduced propellant chamber volume and displaying ribs according to one embodiment of the present invention.

FIG. 6 depicts a side, cross-sectional view of a portion of the polymeric cartridge case displaying ribs according to one embodiment of the present invention. One embodiment that reduces bellowing of the insert includes a shortened insert and angled coupling element 30 inside of the insert. In addition, the raised portion of the polymer at the primer flash hole 40 was removed, the internal polymer wall was lowered and angled to match the insert and the internal ribs were lengthened. The polymer casing 12 has a substantially cylindrical opposite end 20. The bullet-end component 18 may be formed with coupling end 22 formed on end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A flash hole aperture 42 extends through the bottom surface 34 into the propellant chamber 14. The coupling end 22 extends the polymer through the primer flash hole 40 to form an aperture coating 42 while retaining a passage from the top surface 36 through the bottom surface 34 and into the propellant chamber 14 to provide support and protection about the primer flash hole 40. The propellant chamber 14 includes a propellant chamber insert 66 that extends from the bottom surface 34 to the shoulder 24. The thickness of the propellant chamber insert 66 may be defined as the distance from the propellant chamber 14 to the interior of the middle body component 28 and may be varied as necessary to achieve the desired velocity depending on the propellant used. The propellant chamber insert 66 may be made of the same material as the casing or a different material. The propellant chamber insert 66 may be formed by extending the casing wall or may be made by forming a separate insert that is formed and then inserted into the propellant chamber 14 during assembly. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The substantially cylindrical opposite end 20 or anywhere within the propellant chamber 14 may include one or more ribs 48 on the surface. The number of ribs 48 will depend on the specific application and desire of the manufacture but may include 1, 2, 3, 4, 5 6, 7, 8, 9, 10, or more ribs. In the counter bore, the polymer was having difficulty filling this area due to the fact that the polymer used has fillers in it, and needed to be reblended during molding. One embodiment includes six ribs 48 to create turbulence in the flow of the polymer, thus allowing the material to fill the counter bore. Another embodiment of the instant invention is a shortened insert and angled coupling element 30 inside of the insert. In addition, raised portions of the polymer at the flash hole 40, lowered and angled the internal polymer wall to match the insert and lengthened the internal ribs.

Figure 7:
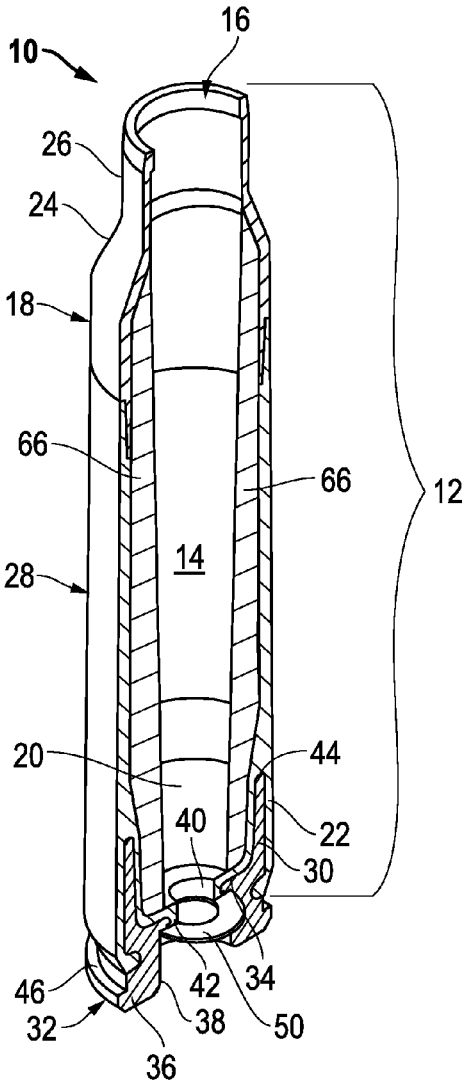
FIG. 7 depicts a side, cross-sectional view of a polymeric cartridge case having a reduced propellant chamber volume and a diffuser according to one embodiment of the present invention.

FIG. 7 depicts a side, cross-sectional view of a polymeric cartridge case having a diffuser according to one embodiment of the present invention. The diffuser 50 is a device that is used to divert the affects of the primer off of the polymer and directing it to the flash hole 40. The affects being the impact from igniting the primer as far as pressure and heat. A cartridge 10 suitable for use with high velocity rifles is shown manufactured with a polymer casing 12 showing a propellant chamber 14 with projectile (not shown) inserted into the forward end opening 16. Polymer casing 12 has a substantially cylindrical open-ended polymeric bullet-end component 18 extending from forward end opening 16 rearward to the opposite end 20. The bullet-end component 18 may be formed with coupling end 22 formed on end 20. Coupling end 22 is shown as a female element, but may also be configured as a male element in alternate embodiments of the invention. The forward end of bullet-end component 18 has a shoulder 24 forming chamber neck 26.

The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 of bullet-end component 18 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A flash hole aperture 42 extends through the bottom surface 34 into the propellant chamber 14. The coupling end 22 extends the polymer through the primer flash hole 40 to form an aperture coating 42 while retaining a passage from the top surface 36 through the bottom surface 34 and into the propellant chamber 14 to provides support and protection about the primer flash hole 40. The propellant chamber 14 includes a propellant chamber insert 66 that extends from the bottom surface 34 to the shoulder 24. The thickness of the propellant chamber insert 66 may be defined as the distance from the propellant chamber 14 to the interior of the middle body component 28 and may be varied as necessary to achieve the desired velocity depending on the propellant used. The propellant chamber insert 66 may be made of the same material as the casing or a different material. The propellant chamber insert 66 may be formed by extending the casing wall or may be made by forming a separate insert that is formed and then inserted into the propellant chamber 14 during assembly. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component extends from a forward end opening 16 to coupling element 22. Located in the top surface 36 is a primer recess 38 that extends toward the bottom surface 34 with a diffuser 50 positioned in the primer recess 38. The diffuser 50 includes a diffuser aperture 52 that aligns with the primer flash hole 40. The diffuser 50 is a device that is used to divert the affects of the primer (not shown) off of the polymer. The affects being the impact from igniting the primer as far as pressure and heat to divert the energy of the primer off of the polymer and directing it to the flash hole.

Figure 8:
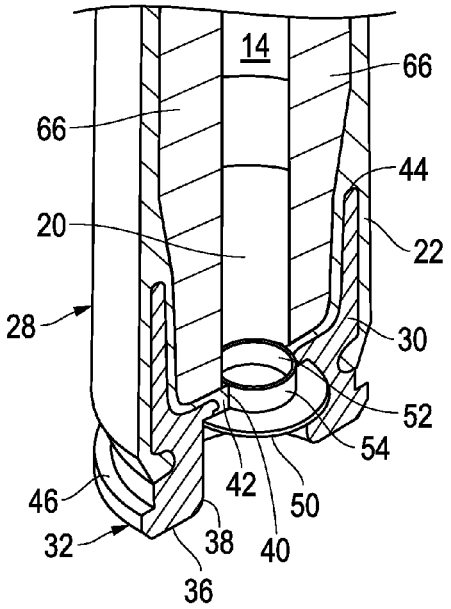
FIG. 8 depicts a side, cross-sectional view of a portion of the polymeric cartridge case having a reduced propellant chamber volume and a diffuser according to one embodiment of the present invention.
Figure 9A:
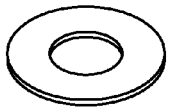
FIGS. 9A-9H depict diffuser according to a different embodiment of the present invention.
Figure 9B:
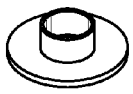
Figure 9C:
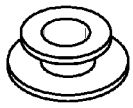
Figure 9D:
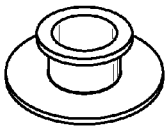
Figure 9E:
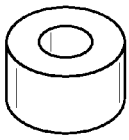
Figure 9F:
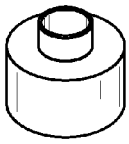
Figure 9G:
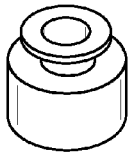
Figure 9H:
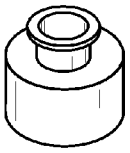

FIG. 8 depicts a side, cross-sectional view of a portion of the polymeric cartridge case having a diffuser 50 according to one embodiment of the present invention. A portion of a cartridge suitable for use with high velocity rifles is shown manufactured with a polymer casing 12 showing a propellant chamber 14. Polymer casing 12 has a substantially cylindrical opposite end 20. The bullet-end component 18 may be formed with coupling end 22 formed on end 20. Coupling end 22 is shown as a female element, but may also be configured as a male element in alternate embodiments of the invention. The middle body component (not shown) is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A flash hole aperture 42 extends through the bottom surface 34 into the propellant chamber 14. The propellant chamber 14 includes a propellant chamber insert 66 that extends from the bottom surface 34 to the shoulder 24. The thickness of the propellant chamber insert 66 may be defined as the distance from the propellant chamber 14 to the interior of the middle body component 28 and may be varied as necessary to achieve the desired velocity depending on the propellant used. The propellant chamber insert 66 may be made of the same material as the casing or a different material. The propellant chamber insert 66 may be formed by extending the casing wall or may be made by forming a separate insert that is formed and then inserted into the propellant chamber 14 during assembly. The coupling end 22 extends the polymer through the primer flash hole aperture 42 to form a primer flash hole 40 while retaining a passage from the top surface 36 through the bottom surface 34 and into the propellant chamber 14 to provides support and protection about the primer flash hole 40. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. Located in the top surface 36 is a primer recess 38 that extends toward the bottom surface 34 with a diffuser 50 positioned in the primer recess 38. The diffuser 50 includes a diffuser aperture 52 and a diffuser aperture extension 54 that aligns with the primer flash hole 40. The diffuser 50 is a device that is used to divert the affects of the primer (not shown) off of the polymer. The affects being the impact from igniting the primer as far as pressure and heat to divert the energy of the primer off of the polymer and directing it to the flash hole 40. The diffuser 50 can be between 0.004 to 0.010 inches in thickness and made from half hard brass. For example, the diffuser 50 can be between 0.005 inches thick for a 5.56 diffuser 50. The OD of the diffuser for a 5.56 or 223 case is 0.173 and the ID is 0.080. The diffuser could be made of any material that can withstand the energy from the ignition of the primer. This would include steel, stainless, cooper, aluminum or even an engineered resin that was injection molded or stamped. The diffuser can be produce in T shape by drawing the material with a stamping and draw die. In the T shape diffuser the center ring can be 0.005 to 0.010 tall and the OD is 0.090 and the ID 0.080.

FIGS. 9A-9H depict different embodiment of the diffuser of the present invention.

Figure 10A:
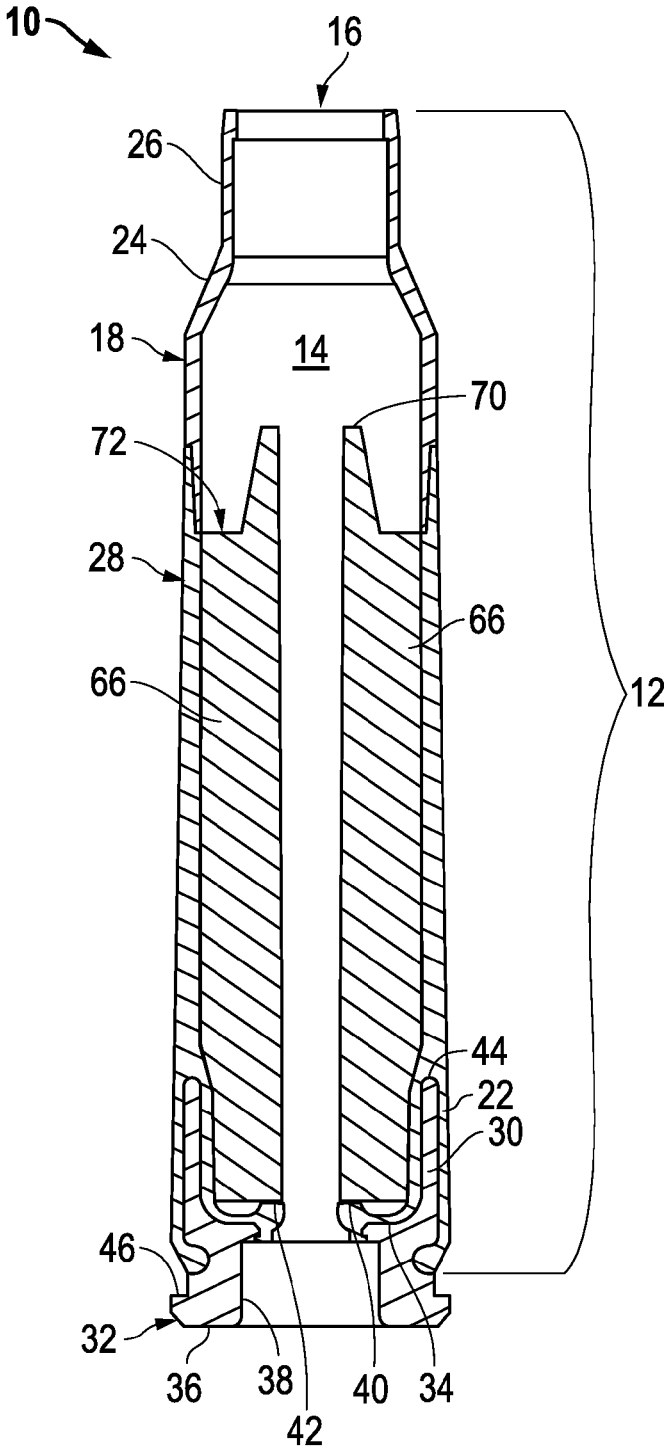
FIGS. 10A and 10B depict a cross-sectional view of a polymeric cartridge case having a reduced propellant chamber volume according to one embodiment of the present invention.
Figure 10B:
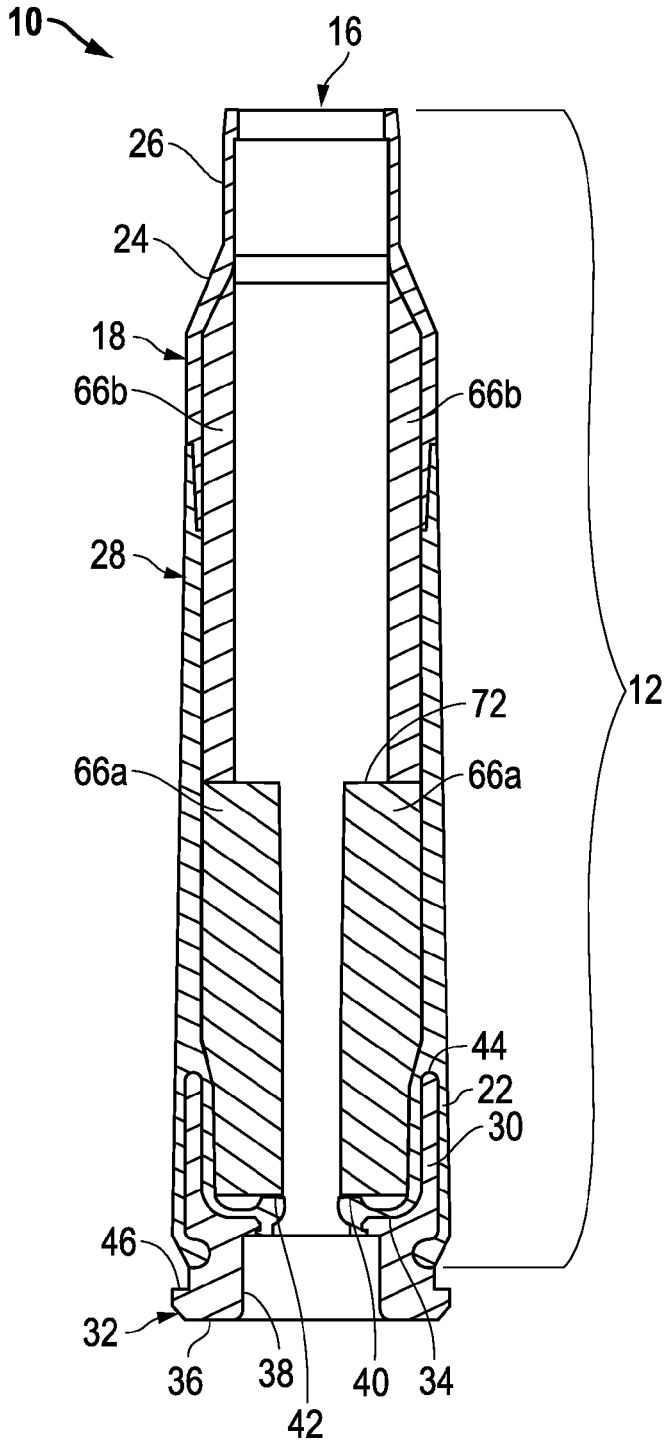

FIGS. 10A and 10B depict a cross-sectional view of a polymeric cartridge case having a reduced propellant chamber volume according to one embodiment of the present invention. A cartridge casing 10 shows a casing 12 showing a propellant chamber 14 with a projectile (not shown) inserted into the forward end opening 16. The cartridge casing 12 has a substantially cylindrical open-ended bullet-end component 18 extending from the forward end opening 16 rearward to the opposite end 20. The forward end of bullet-end component 18 has a shoulder 24 forming a chamber neck 26. The bullet-end component 18 may be formed with coupling end 22 formed on substantially cylindrical opposite end 20 or formed as a separate component. The bullet-end, middle body component 28, bullet (not shown) and other casing components can then be welded or bonded together using solvent, adhesive, spin-welding, vibration-welding, ultrasonic-welding or laser-welding techniques. The welding or bonding increases the joint strength so the casing can be extracted from the hot gun after firing at the cook-off temperature. Other possible securing methods include, but are not limited to, mechanical interlocking methods such as ribs and threads, adhesives, molding in place, heat crimping, ultrasonic welding, friction welding etc. These and other suitable methods for securing individual pieces of a two-piece or multi-piece cartridge casing are useful in the practice of the present invention. Coupling end 22 is shown as a female element, but may also be configured as a male element in alternate embodiments of the invention. The forward end of bullet-end component 18 has a shoulder 24 forming chamber neck 26. The bullet-end component typically has a wall thickness between about 0.003 and about 0.200 inches and more preferably between about 0.005 and about 0.150 inches and more preferably between about 0.010 and about 0.050 inches. The middle body component 28 is substantially cylindrical and connects the forward end of bullet-end component 18 to the substantially cylindrical opposite end 20 and forms the propellant chamber 14. The substantially cylindrical opposite end 20 includes a substantially cylindrical insert 32 that partially seals the propellant chamber 14. The substantially cylindrical insert 32 includes a bottom surface 34 located in the propellant chamber 14 that is opposite a top surface 36. The substantially cylindrical insert 32 includes a primer recess 38 positioned in the top surface 36 extending toward the bottom surface 34 with a primer flash hole aperture 42 is located in the primer recess 38 and extends through the bottom surface 34 into the propellant chamber 14 to combust the propellant in the propellant chamber 14. A primer (not shown) is located in the primer recess 38 and extends through the bottom surface 34 into the propellant chamber 14. When molded the coupling end 22 extends the polymer through the primer flash hole aperture 42 to form the primer flash hole 40 while retaining a passage from the top surface 36 through the bottom surface 34 and into the propellant chamber 14 to provide support and protection about the primer flash hole aperture 42. The bullet-end 18, middle body 28 and bottom surface 34 define the interior of propellant chamber 14 in which the powder charge (not shown) is contained. The interior volume of propellant chamber 14 may be varied to provide the volume necessary for complete filling of the propellant chamber 14 by the propellant chosen so that a simplified volumetric measure of propellant can be utilized when loading the cartridge. The propellant chamber 14 includes a propellant chamber insert 66 that extends from the bottom surface 34 to the shoulder 24. The thickness of the propellant chamber insert 66 may be defined as the distance from the propellant chamber 14 to the interior of the middle body component 28 and may be varied as necessary to achieve the desired velocity depending on the propellant used. The propellant chamber 14 includes a propellant chamber insert 66 that extends from the bottom surface 34 to the shoulder 24 at a graduated distance from the propellant chamber 14 to the interior of the middle body component 28. For example, FIG. 10A shows a propellant chamber insert 66 extends from the bottom of the polymeric cartridge case 12 toward the shoulder 24. This includes an extended primer flash hole 40 that connects the primer recess 38 and the propellant chamber 14. The propellant chamber insert 66 may include a burn tube extension 70 that sits above the propellant chamber bottom 72 of the propellant chamber 14. FIG. 10B shows a polymeric cartridge case having a 2 piece insert. The propellant chamber 14 has a first propellant chamber insert 66*a* that extends from the polymeric cartridge case 12 toward the shoulder 24 ending at any point between the primer recess 38 and the shoulder 24. The first propellant chamber insert 66*a* extends about half way the polymeric cartridge case 12 to form the propellant chamber bottom 72 of the propellant chamber 14. A second propellant chamber insert 66*b* extends from the propellant chamber bottom 72 toward the shoulder 24. The first propellant chamber insert 66*a* and the second propellant chamber insert 66*b* may be of similar or different materials and have similar or different thicknesses to form propellant chamber 14 of different volumes. The propellant chamber insert 66 may be formed by extending the casing wall or may be made by forming a separate insert (not shown) that is formed and then inserted into the propellant chamber 14 during assembly.

The substantially cylindrical insert 32 also has a flange 46 cut therein and a primer recess 38 formed therein for ease of insertion of the primer (not shown). The primer recess 38 is sized so as to receive the primer (not shown) in an interference fit during assembly. The cartridge casing 12 may be molded from a polymer composition with the middle body component 28 being over-molded onto the substantially cylindrical insert 32. When over-molded the coupling end 22 extends the polymer through the primer flash hole aperture 42 to form the primer flash hole 40 while retaining a passage from the top surface 36 through the bottom surface 34 and into the propellant chamber 14 to provide support and protection about the primer flash hole aperture 42. The primer flash hole 40 communicates through the bottom surface 34 of substantially cylindrical insert 32 into the propellant chamber 14 so that upon detonation of primer (not shown) the propellant (not shown) in propellant chamber 14 will be ignited. The bullet-end component 18 and middle body component 28 can be welded or bonded together using solvent, adhesive, spin-welding, vibration-welding, ultrasonic-welding or laser-welding techniques.

The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. Coupling end 22 of bullet-end component 18 fits about and engages coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash hole 40 extends through the bottom surface 34 into the propellant chamber 14. The coupling end 22 extends the polymer through the flash hole aperture 42 to form a primer flash hole 40 while retaining a passage from the top surface 36 through the bottom surface 34 and into the propellant chamber 14. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component extends from a forward end opening 16 to coupling element 22. The middle body component typically has a wall thickness between about 0.003 and about 0.200 inches and more preferably between about 0.005 and more preferably between about 0.150 inches about 0.010 and about 0.050 inches.

It is understood that the propellant chamber insert 66 can be of any geometry and profile to reduce the propellant chamber volume. The propellant chamber insert 66 may be uniformed in the geometry and profile or may vary in geometry, profile or both to achieve the desired burn and propellant chamber volume. In addition, the propellant chamber insert can be formed simultaneously with the case by over-molding or machining or can be prepared separate from the case and assembled sequentially. The propellant chamber insert 66 can be bonded, welded or otherwise affixed to the case.

One embodiment includes a 2 cavity mold having an upper portion and a base portion for a 5.56 case having a metal insert over-molded with a Nylon 6 (polymer) based material. In this embodiment, the polymer in the base forms a lip or flange to extract the case from the weapon. One 2-cavity mold to produce the upper portion of the 5.56 case can be made using a stripper plate tool using an Osco hot spur and two subgates per cavity. Another embodiment includes a subsonic version, the difference from the standard and the subsonic version is the walls are thicker thus requiring less powder to decrease the velocity of the bullet creating a subsonic round.

The extracting inserts is used to give the polymer case a tough enough ridge and groove for the weapons extractor to grab and pull the case out the chamber of the gun. The extracting insert is made of 17-4 SS that is hardened to 42-45 rc. The insert may be made of aluminum, brass, cooper, steel or even an engineered resin with enough tensile strength.

The insert is over molded in an injection molded process using a nano clay particle filled Nylon material. The inserts can be machined or stamped. In addition, an engineered resin able to withstand the demand on the insert allows injection molded and/or even transfer molded.

One of ordinary skill in the art will know that many propellant types and weights can be used to prepare workable ammunition and that such loads may be determined by a careful trial including initial low quantity loading of a given propellant and the well known stepwise increasing of a given propellant loading until a maximum acceptable load is achieved. Extreme care and caution is advised in evaluating new loads. The propellants available have various burn rates and must be carefully chosen so that a safe load is devised.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A method of preparing a polymeric subsonic ammunition comprising the steps of:

providing a substantially cylindrical primer insert comprising a base having a top surface opposite a bottom surface, a substantially cylindrical coupling flange that extends from the top surface, a primer recess in the bottom surface, a flash hole aperture positioned in the primer recess extending through the bottom surface, a flash aperture groove positioned in the primer recess around the flash hole aperture, and an extraction flange positioned about the circumference of the bottom surface;

forming a polymeric middle body by molding at a first end a first polymer composition over the substantially cylindrical coupling flange into the flash hole aperture and into the flash aperture groove and molding a second end comprising a neck coupling region, wherein the first polymer composition extends from the neck coupling region to the flash aperture groove to form the polymeric middle body to form a propellant chamber having a propellant chamber volume;

forming a polymeric bullet-end component from a second polymer composition, wherein the polymeric bullet-end component comprises a polymeric coupling region opposite a bullet aperture separated by a neck region;

positioning a propellant chamber insert in the propellant chamber to reduce the propellant chamber volume by between 25 and 80% to a subsonic propellant chamber volume; and coupling the neck coupling region to the polymeric coupling region to form a subsonic propellant chamber from the bullet aperture to the primer flash hole aperture.

2. The method of claim 1, wherein the polymeric bullet-end component comprises a shoulder positioned between the substantially cylindrical polymeric coupling end and the bullet aperture.

3. The method of claim 1, wherein the subsonic propellant chamber volume is about 25.1, 25.2, 25.3, 25.4, 25.5, 25.6, 25.7, 25.8, 25.9, 26.0, 26.25, 26.5, 26.75, 27, 27.5, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80% or incremental variations thereof less than the propellant chamber volume.

4. The method of claim 1, wherein the subsonic propellant chamber volume contains a propellant volume such that a projectile does not exceed a velocity of 1200 feet per second at sea level under standard atmospheric conditions when fired.

5. The method of claim 1, wherein the subsonic propellant volume limits the velocity of a projectile to less than 1086 feet per second at standard atmospheric conditions when fired.

6. The method of claim 1, further comprising the step of securing a projectile to the bullet aperture by a mechanical interference, adhesive, ultrasonic welding, the combination of molding in place and adhesive, or hot crimping after molding.

7. The method of claim 1, wherein the first polymer composition comprises a polymers, copolymers of individual monomers selected from the group consisting of polybutylene terephthalates, polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadiene-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly (etherimide-siloxane) copolymers, blends of polyetherimides and polysiloxanes, and blends of polyetherimides and poly(etherimide-siloxane) copolymers and copolymer mixtures thereof.

8. The method of claim 1, wherein the second polymer composition comprises a polymer, copolymer of individual monomers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadiene-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers.

9. The method of claim 1, wherein the propellant chamber insert comprises a polymer, copolymer of individual monomers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadiene-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly (etherimide-siloxane) copolymers, blends of polyetherimides and polysiloxanes, and blends of polyetherimides and poly(etherimide-siloxane) copolymers.

10. The method of claim 1, wherein the first polymer composition, the second polymer composition and the propellant insert independently comprise a material selected from the group consisting of polyphenylsulfone, polycarbonate, and polyamide.

11. The method of claim 1, wherein the first polymer composition, the second polymer composition and the propellant insert independently comprise at least one additive selected from the group consisting of plasticizers, lubricants, molding agents, fillers, thermo-oxidative stabilizers, flame-retardants, coloring agents, compatibilizers, impact modifiers, release agents, reinforcing fibers and reinforcing agents.

12. The method of claim 1, wherein the propellant chamber insert has a substantially cylindrical shape.

13. The method of claim 1, wherein the propellant chamber insert has a free formed shape.

14. The method of claim 1, wherein the propellant chamber insert has a one or more ribs extending into the propellant chamber.

15. The method of claim 1, wherein the propellant chamber insert has a radial cross-section selected from the group consisting of circular, ovoid, octagonal, hexagonal, triangular, star, ribbed, square and a combination thereof.

16. The method of claim 1, wherein the radial cross-section of the propellant chamber insert is irregular in shape or tapers along its longitudinal length.

17. The method of claim 1, wherein the polymeric middle body, the polymeric bullet-end component and the propellant chamber insert independently comprise the same polymeric material or different polymeric materials.

* * * * *